US010278547B2

(12) United States Patent
Morin et al.

(10) Patent No.: US 10,278,547 B2
(45) Date of Patent: May 7, 2019

(54) DOOR ASSEMBLY FOR A BATHING ENCLOSURE

(71) Applicant: MAAX BATH INC., Lachine (CA)

(72) Inventors: Marco Morin, Lévis (CA); Steve Donnelly, Saint-Antoine de Tilly (CA); Mathieu Dufresne, Ile-Perrot (CA); Vincent Morissette, St Hubert (CA)

(73) Assignee: MAAX BATH INC., Lachine, Quebec (CA)

( * ) Notice: Subject to any disclaimer, the term of this patent is extended or adjusted under 35 U.S.C. 154(b) by 166 days.

(21) Appl. No.: 15/584,079

(22) Filed: May 2, 2017

(65) Prior Publication Data

US 2017/0311763 A1 Nov. 2, 2017

Related U.S. Application Data

(60) Provisional application No. 62/330,407, filed on May 2, 2016.

(51) Int. Cl.

| | |
|---|---|
| ***A47K 3/36*** | (2006.01) |
| ***E06B 3/50*** | (2006.01) |
| ***E05D 15/58*** | (2006.01) |
| ***E05D 15/06*** | (2006.01) |
| ***E05D 15/10*** | (2006.01) |
| *E05D 3/14* | (2006.01) |

(52) U.S. Cl.

CPC ..... *A47K 3/362* (2013.01); *E05D 15/0608* (2013.01); *E05D 15/1042* (2013.01); *E05D 15/58* (2013.01); *E06B 3/509* (2013.01); *E06B 3/5081* (2013.01); *E05D 3/14* (2013.01); *E05D 2015/1055* (2013.01); *E05Y 2600/502* (2013.01); *E05Y 2600/628* (2013.01); *E05Y 2800/102* (2013.01); *E05Y 2900/114* (2013.01)

(58) Field of Classification Search

CPC ..... A47K 3/362; A47K 3/34; E06B 3/509; E06B 3/5081; E06B 3/5072; E05D 15/0608; E05D 15/58; E05D 15/08; E05D 15/48; E05D 15/585; E05D 15/485; E05D 15/0604; E05Y 2900/114

See application file for complete search history.

(56) References Cited

U.S. PATENT DOCUMENTS 4,878,530 A * 11/1989 Jean ..... A47K 3/34 160/211
5,893,181 A * 4/1999 Moncaster ..... A47K 3/362 160/211
5,911,519 A * 6/1999 Eutebach ..... A47K 3/362 4/607

(Continued)

*Primary Examiner* — Justin B Rephann
(74) *Attorney, Agent, or Firm* — Morgan, Lewis & Bockius LLP

(57) ABSTRACT

There is described a door assembly for a bathing enclosure, comprising: a frame; a rotatable panel rotatably securable to a wall; and a slidable panel slidably secured to the frame, wherein a sliding motion of the slidable panel triggers a rotation of the rotatable panel, wherein the door assembly is movable between an open position and a closed position, wherein when the door assembly is in the closed position, the rotatable and slidable panels are adjacent to one another and are unparallel and wherein when the door assembly is in the open position, the rotatable and slidable panels overlap one another and are parallel together.

20 Claims, 17 Drawing Sheets

(56) References Cited

U.S. PATENT DOCUMENTS

| | | | | |
|---|---|---|---|---|
| 2007/0169899 | A1* | 7/2007 | Cianciolo | E05D 15/08 160/211 |
| 2014/0068853 | A1* | 3/2014 | Opwald | A47K 3/362 4/607 |
| 2015/0113724 | A1* | 4/2015 | Corpuz, Jr. | A47K 3/36 4/607 |
| 2017/0204644 | A1* | 7/2017 | Mc Mullen, Jr. | E05D 15/58 |

* cited by examiner

DOOR ASSEMBLY FOR A BATHING ENCLOSURE

TECHNICAL FIELD

The invention relates to shower or bathtub doors, and more specifically to sliding door assemblies for shower or bathtub enclosures.

BACKGROUND

Sliding door assemblies for bathing enclosures such as shower enclosures or bathtub enclosures usually include a fixed panel which is disposed on a first vertical plane and a slidable door panel which is disposed on a second vertical plane parallel to the first vertical plane. The slidable door panel is adapted to slide along the second vertical plane relative to the fixed panel. The slidable door panel overlaps the fixed panel when the door assembly is open, thereby creating a access opening into the enclosure next to the fixed panel, and is moved in front of the access opening to close the door assembly.

In most shower or bathtub door assemblies, the slidable door panel still overlaps partially the fixed panel when the door assembly is closed. Unfortunately, this creates an area between the slidable door panel and the fixed panel which is relatively hard to reach, and therefore relatively hard to clean.

There is therefore a need for a system which can overcome at least one of the above-identified drawbacks.

BRIEF SUMMARY

According to a broad aspect, there is provided a door assembly for a bathing enclosure, comprising: a frame; a rotatable panel rotatably securable to a wall; and a slidable panel slidably secured to the frame, wherein a sliding motion of the slidable panel triggers a rotation of the rotatable panel, wherein the door assembly is movable between an open position and a closed position, wherein when the door assembly is in the closed position, the rotatable and slidable panels are adjacent to one another and are unparallel and wherein when the door assembly is in the open position, the rotatable and slidable panels overlap one another and are parallel together.

In one embodiment, the door assembly further comprises a first guide member secured to the rotatable panel and a second guide member secured to the slidable panel and engageable with the first guide member for triggering the rotation of the rotatable panel.

In one embodiment, wherein the first guide member comprises a groove extending therealong.

In one embodiment, the groove comprises a first groove portion being parallel to the rotatable panel and a second groove portion extending from the first groove portion at an angle therefrom, the second groove portion being adjacent to the slidable panel when the door assembly is in the closed position.

In one embodiment, the second guide member comprises a pin sized and shaped to be received in the groove, a motion of the pin within the groove triggering the rotation of the rotatable panel.

In one embodiment, the door assembly further comprises a rail member extending along the frame and a roller assembly secured to the slidable panel and engaging the rail member to allow a sliding motion of the slidable panel relative to the frame.

In one embodiment, the door assembly further comprises a rotating connector assembly securable to the wall and the rotatable panel.

In one embodiment, the rotating connector assembly comprises a plate securable to the wall and a panel receiving member rotatably secured to the plate, the panel receiving member for receiving the rotatable panel therein.

In one embodiment, the plate comprises a cylindrical protrusion protruding therefrom and the panel receiving member comprises a cylindrical recess for receiving the cylindrical protrusion therein and allowing a rotation of the panel receiving member relative to the plate.

In one embodiment, the panel receiving member has a substantially U-shape for receiving the rotatable panel therein.

In one embodiment, the panel receiving member composes a male jaw portion and a female jaw portion rotatably secured to the male jaw portion, the rotatable panel being receivable between the male and female jaw portions.

In one embodiment, the door assembly further comprises a securing means for fixedly securing the male and female jaw portions together once the rotatable panel is received therebetween.

In one embodiment, the securing means comprises a bolt, the female jaw portion comprises an opening for receiving the bolt therein, the bolt abutting against the male jaw portion when inserted into the opening for fixedly securing the rotatable panel between the male and female jaw portions.

In one embodiment, the door assembly further comprises a first anti-skid body to be installed between the male jaw portion and the rotatable panel and a second anti-skid body to be installed between the female jaw portion and the rotatable panel.

In one embodiment, the rotatable and slidable panels are made of glass.

In one embodiment, the bathing enclosure is a shower enclosure.

In another embodiment, the bathing enclosure is a bathtub enclosure.

In one embodiment, the wall is a bathroom wall.

In another embodiment, the wall is part of the frame.

According to another broad aspect, there is provided a door assembly for one of a tub and a shower, comprising: a frame; a first door panel; a rotatable connector securable to a wall and secured to the first door panel for allowing a rotation of the first door panel relative to the wall; a second door panel; a sliding member secured to the frame and operatively connected to the second door panel for allowing a sliding motion of the second door panel along the frame; a first guide member secured to the first door panel; and a second guide member secured to the second door panel and operatively connected to the first guide member for triggering the rotation of the first door panel upon sliding of the second door panel.

Further details of the invention and its advantages will be apparent from the detailed description included below.

DETAILED DESCRIPTION

In the following description of the embodiments, references to the accompanying drawings are by way of illustration of an example by which the invention may be practiced. It will be understood that other embodiments may be made without departing from the scope of the invention disclosed.

Figure 1:
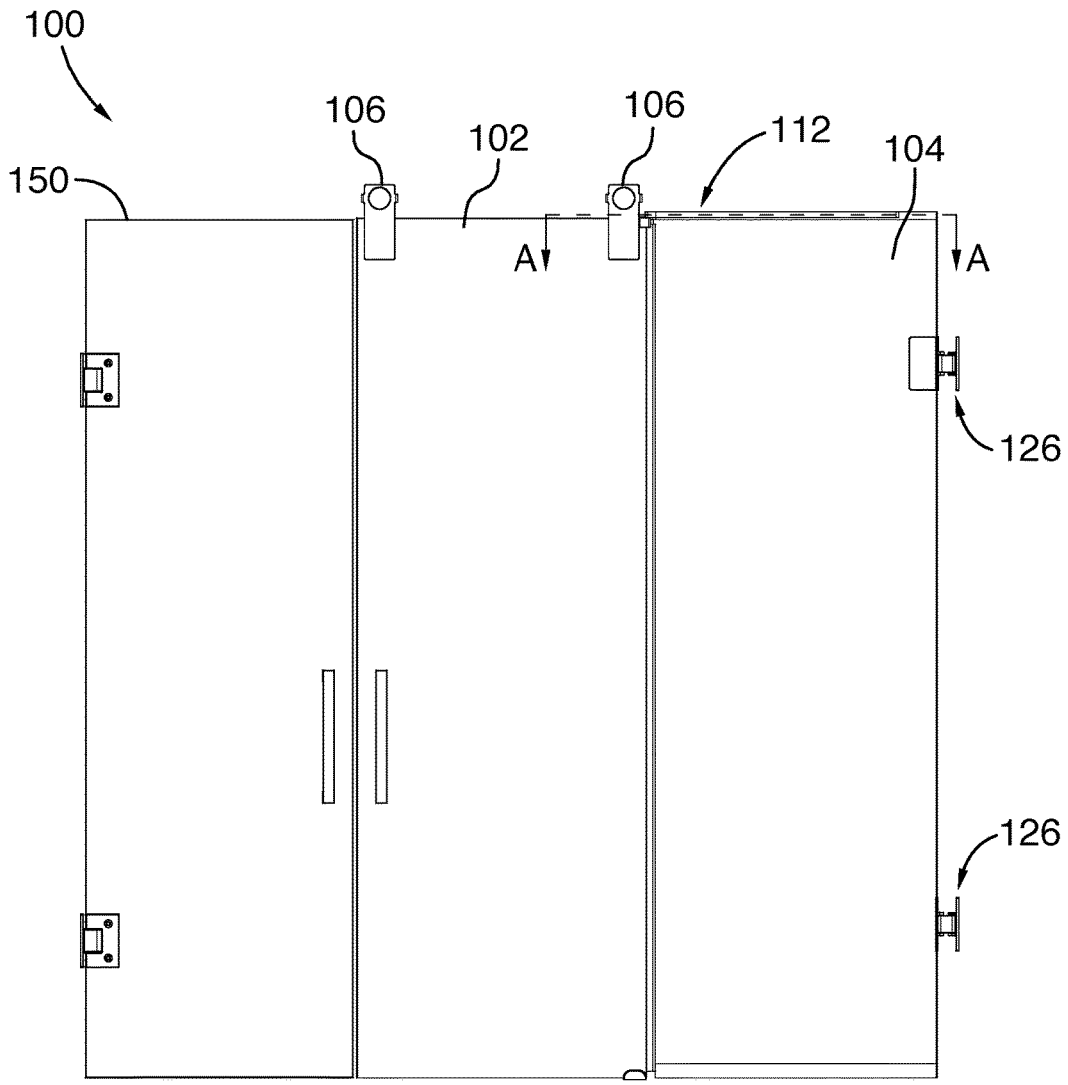
FIG. 1 is a drawing showing a rear elevation view of a door assembly for a bathing enclosure, in accordance with one embodiment, with the door assembly in a closed position.
Figure 2:
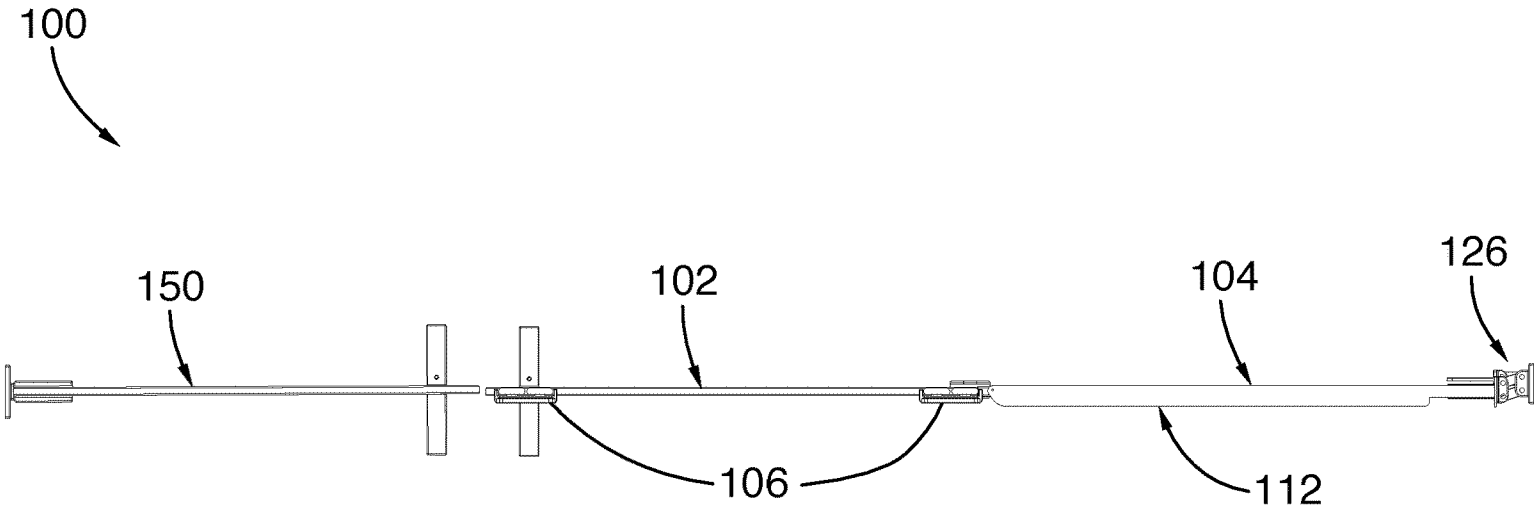
FIG. 2 is a drawing showing a top view of the door assembly illustrated in FIG. 1.
Figure 2A:
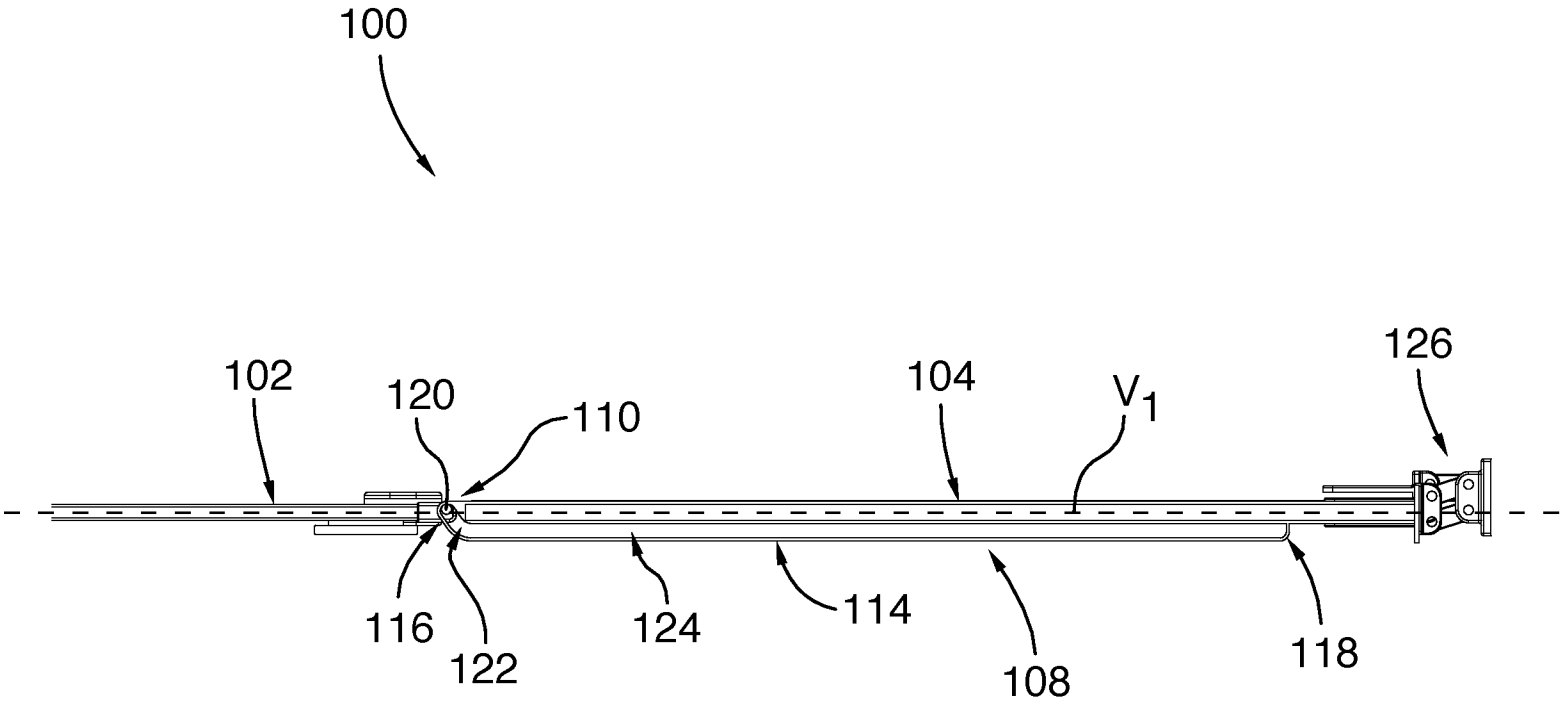
FIG. 2A is a drawing showing a top cross-section view of the door assembly illustrated in FIG. 1, taken along cross-section line A-A.
Figure 2B:
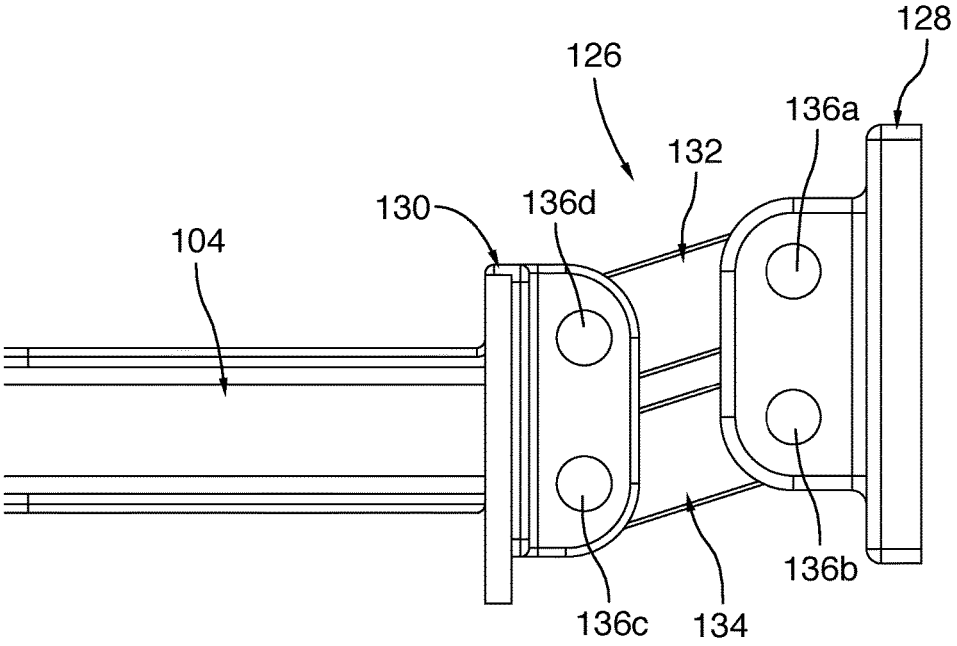
FIG. 2B is a drawing showing an top view of the door assembly illustrated in FIG. 2, enlarged to show details of the four-bar link connection.

Referring first to FIGS. 1 to 2B, there is provided a door assembly 100 for a shower enclosure, not shown. In the accompanying drawings, the door assembly 100 is shown from a front or exterior view, such that FIG. 1 shows the door assembly 100 as would be seen from a viewer standing outside the shower enclosure.

FIGS. 1 and 2 shows the door assembly 100 in a closed position. The door assembly 100 includes a door panel 102 and a fixed panel 104. When in the closed position, the door panel 102 is substantially parallel to the fixed panel 104. In this position, the door panel 102 and the fixed panel 104 extends within a first vertical plane $V_1$ as illustrated in FIG. 2A. In the closed position, the door panel 102 is located adjacent the fixed panel 104 and does not overlap the fixed panel 104. In the illustrated embodiment, the door panel 102 includes a roller assembly 106 adapted to engage a rail member, not shown, which extends along the first vertical plane $V_1$ and which optionally limits movement of the door panel 102 to movement along the first vertical plane $V_1$, as illustrated in FIG. 2A.

Figure 3:
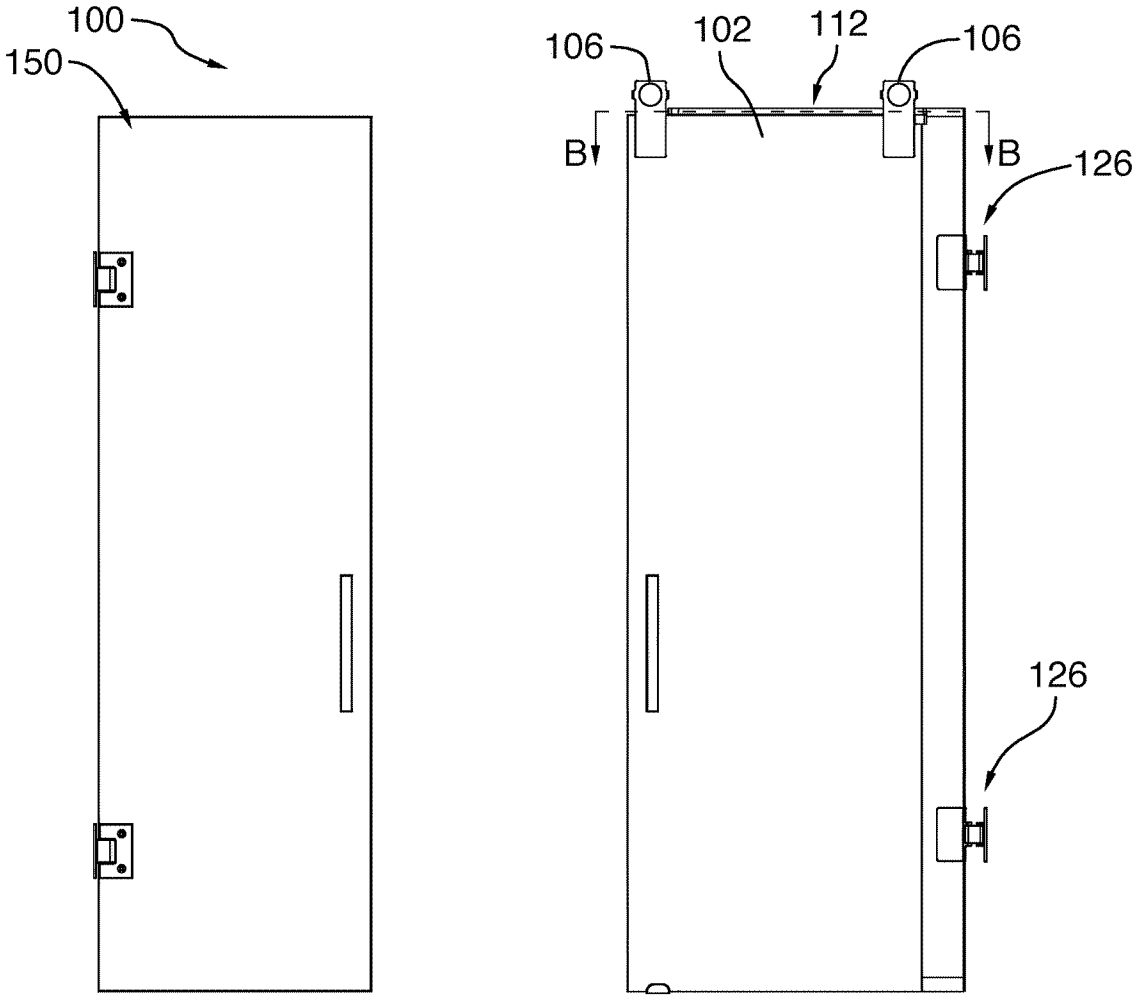
FIG. 3 is a drawing showing a rear elevation view of the door assembly illustrated in FIG. 1, with the door assembly in an open position.
Figure 3A:
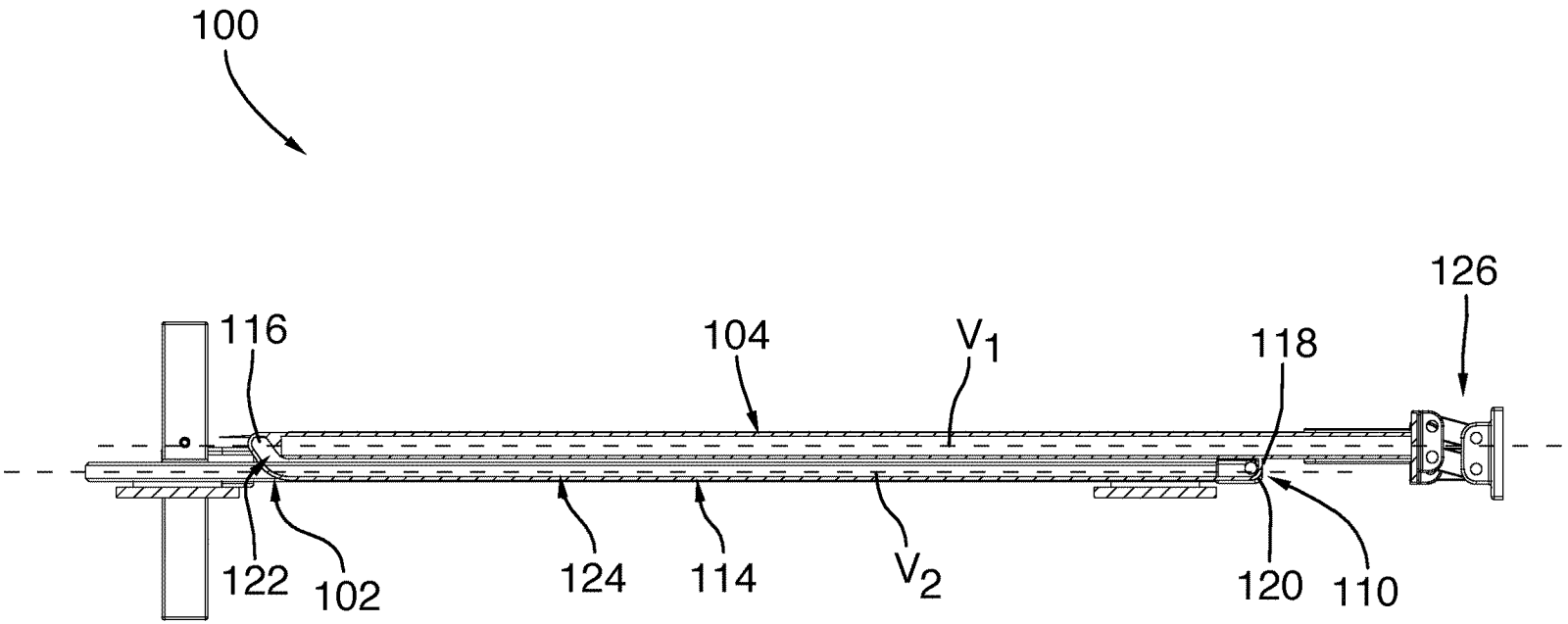
FIG. 3A is a drawing showing a top cross-section view of the door assembly illustrated in FIG. 3, taken along cross-section line B-B.

When the door assembly 100 is opened, the door panel 102 moves from the closed position towards the open position, where the door panel 102 overlaps the door assembly 100. More specifically, when the door panel 102 is moved to the open position, it moves linearly within the first vertical plane $V_1$ towards the fixed panel 104, as shown in FIGS. 3 and 3A.

As it moves along the first vertical plane $V_1$, the fixed panel 104 also moves transversely relative to the first vertical plane $V_1$, away from the first vertical plane $V_1$ and into a second vertical plane $V_2$ which is parallel to and spaced from the first vertical plane $V_1$. As a result, the fixed panel is always substantially parallel to the first vertical plane $V_1$ while moving from the door panel 102 is moved from its closed position to its open position and vice-versa.

In the illustrated embodiment, the fixed panel 104 includes a first guide member 108 and the door panel 102 includes a second guide member 110, the first and second guide members 108, 110 forming together a guiding assembly 112. Still in the illustrated embodiment, the first guide member 108 includes an elongated guiding groove 114 having a first end 116 located towards the door panel 102 and a second end 118 located away from the door panel 102. The second guide member 110 includes a pin 120 which extends upwardly from the door panel 112 and is sized and shaped to be received in the guiding groove 114.

In the illustrated embodiment, the guiding groove 114 is adapted to guide the door panel 102 along a non-linear path of travel as it moves between the open and closed positions. More specifically, the guiding groove 114 includes a first straight portion 122 which is disposed at an angle relative to the first vertical plane $V_1$ and a second straight portion 124 which is disposed parallel to the first vertical plane $V_1$ and at an angle relative to the first straight portion 122. The first straight portion 122 is located near the first end 116 of the guiding groove 114, and the second straight portion 124 is located near the second end 118 of the guiding groove 114.

In the illustrated embodiment, the fixed panel 104 is attached to a shower wall, not shown, via at least one parallelogram link or four-bar link connection 126. The four-bar link connection 126 allows the fixed panel 104 to move transversely to the first vertical plane $V_1$ while remaining parallel to the first vertical plane $V_1$. Specifically, the four-bar link connection 126 includes a first bracket 128 adapted to be secured to a wall, a second bracket 130 disposed opposite the first bracket 128 and a pair of parallel link members 132, 134 connecting the first bracket 128 to the second bracket 130 via four pivots 136*a*, 136*b*, 136*c*, 136*d*.

When the door assembly 100 is in the closed position, the pin 120 is located at the first end 116 of the guiding groove 114 and the door panel 102 is adjacent the fixed panel 104, without overlapping the fixed panel 104. In this position, both the door panel 102 and the fixed panel 104 are disposed in the first vertical plane $V_1$. When the door assembly 100 is moved to the open position to thereby allow access into the shower enclosure, the door panel 102 is pushed edgewise towards the fixed panel 104. Since the roller assembly 106 engages the rail member as described above, the door panel 102 may only move along the first vertical plane $V_1$ and cannot move transversely away from the first vertical plane $V_1$. As the door panel 102 moves towards the open position, the pin 120 moves along the guiding groove 114 towards the second end 118. The pin 120 therefore first moves through the first straight portion 122 of the guiding groove 114, and through the second straight portion 124.

As the pin 120 moves through the first straight portion 122, it forces the fixed panel 102 away from the first vertical plane $V_1$ and towards the second vertical plane $V_2$. Once the pin 120 has passed through the first straight portion 122, it moves through the second straight portion 124, which enables the door panel 102 to move towards the closed position, shown in FIGS. 3 and 3A.

Alternatively, the guiding groove 114 could be curved, or have any other shape which would enable the door panel 102 to move both out of the first vertical plane $V_1$ and into the second vertical plane $V_2$, and towards the fixed panel 104.

In the illustrated embodiment, the door assembly 100 further includes a pivoting panel 150 located adjacent the door panel 102. When in a closed state, the pivoting panel 150 is disposed generally in the first vertical plane $V_1$ and pivots so that it becomes angled from the first vertical plane $V_1$ when the pivoting panel 150 is opened. Alternatively, the door assembly 100 may not comprise a pivoting panel.

While in the above description, the fixed panel remains parallel to the plane V1 while moving from its closed position to its open position, there is described another embodiment in which the fixed panel rotates relative to the plane V1 in which the door panel slides.

In the below described embodiment, a first panel is rotatably secured to a reference surface such as a wall of a bathroom, a wall of the shower enclosure, or the like and a second panel is slidable between a closed position and an open position. When it is in the closed position, the second panel is adjacent to the first panel and does not overlap with the first panel. When it is in the open position, the second panel overlaps with the first panel. It should be understood that the second panel may take a plurality of positions between the open and closed positions. When the second panel is in the open position, the first panel is substantially parallel to the second panel. When the second panel is in the closed position, the first panel is angled relative to the second panel.

When assembled, the second panel may slide linearly within a fixed vertical plane usually along an axis which is parallel to the ground. Sliding the second panel triggers the rotation of the first panel so that the first and second panel be substantially parallel together when the second panel is in the open position and the plane in which the first panel extends intersects that in which the second panel extends.

Figure 4:
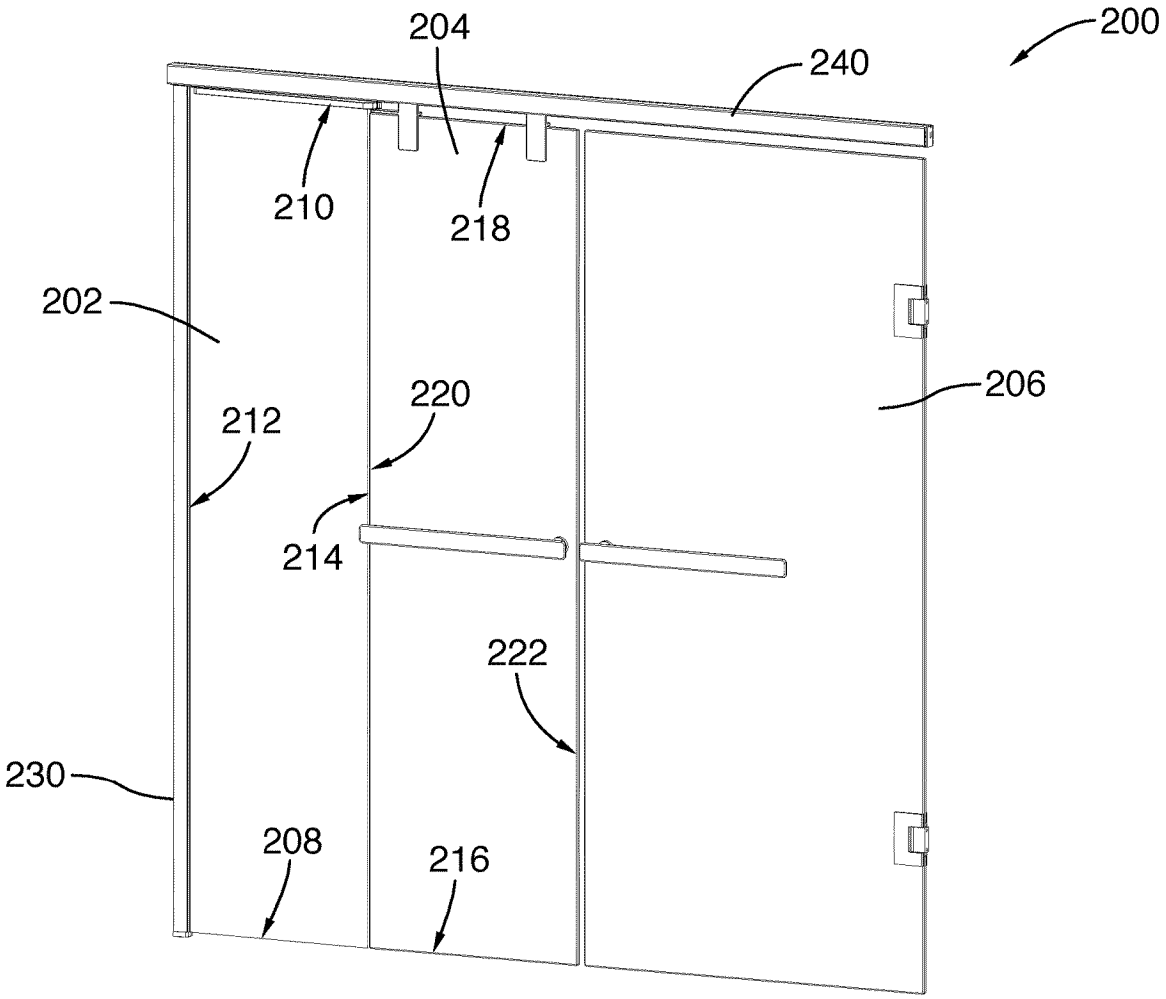
FIG. 4 is a drawing illustrating a door assembly comprising a slidable door panel and a rotatable door panel when in a closed position, in accordance with an embodiment.

FIG. 4 illustrates one embodiment of a door assembly 200 for a shower enclosure, not shown. The door assembly 200 comprises a first rotatable door panel 202, a second slidable door panel 204 and a third optional door panel 206. The first panel 202 is rotatably secured to a shower wall or a bathroom wall while the second panel 204 is slidably secured to the shower enclosure. The third optional panel 206 may be fixed relative to the shower enclosure or be rotatably secured to a further shower wall as illustrated in FIG. 4. The first panel 202 extends longitudinally between a bottom end 208 and a top end 210 and transversally between a first end 212 and a second end 214. The second panel 204 extends longitudinally between a bottom end 216 and a top end 218 and transversally between a first end 220 and a second end 222.

In the embodiment illustrated in FIG. 4, the door assembly 200 is in a closed position/configuration. In this configuration, the first panel 202 is adjacent to the second panel 204 so that there is no overlap between the two. More precisely, the end 214 of the first panel 202 is adjacent to the end 220 of the second panel 204. In one embodiment, the ends 214 and 220 may be spaced apart so as to not be in physical contact when the door assembly 200 is in the closed position. In another embodiment, the ends 214 and 220 may abut one another so as to be in physical contact when the door assembly 200 is in the closed position. Furthermore, when in the closed configuration, the first and second panel 202 and 204 are not parallel to one another.

Figure 5:
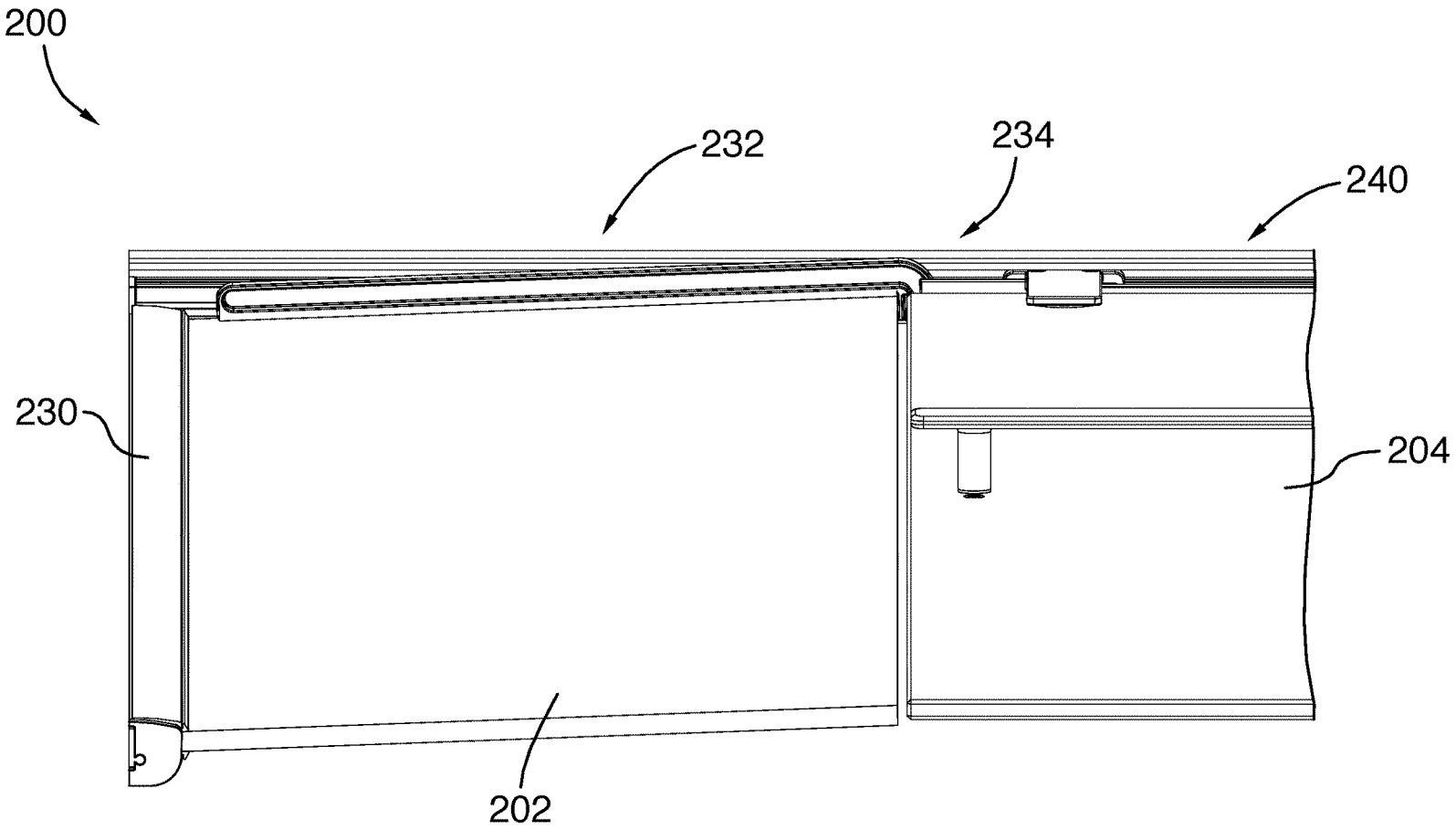
FIG. 5 is a drawing showing a bottom perspective view of the door assembly of FIG. 4.

As illustrated in FIG. 5, the end 212 of the first panel 202 is rotatably secured to a shower wall via a rotatable connection assembly 230. The second panel 204 is slidably secured to the shower assembly or frame and includes a roller assembly such as roller assembly 106 adapted to engage a rail member, not shown. The roller assembly allows a sliding motion of the second panel 204 and may optionally limit movement of the second panel 204.

Figure 1A:
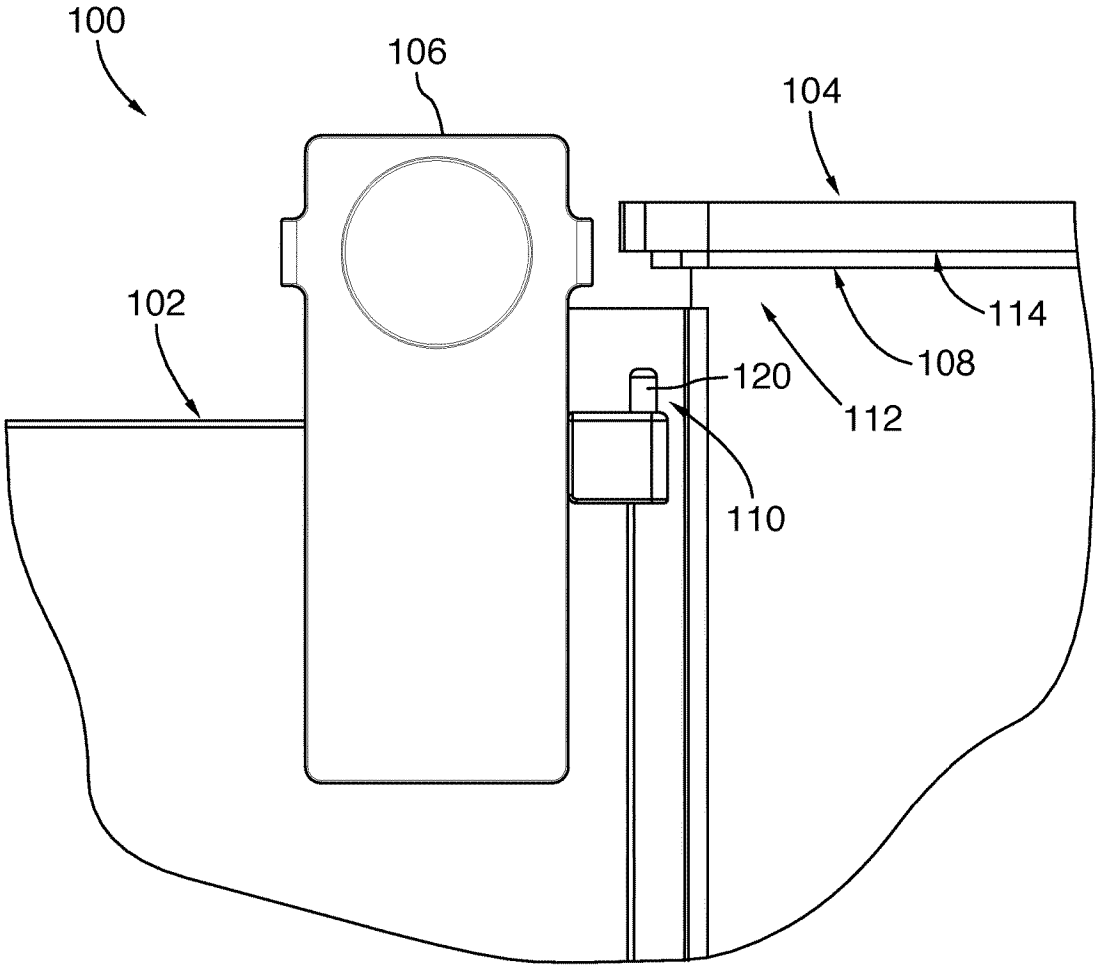
FIG. 1A is a drawing showing an enlarged view of the door assembly illustrated in FIG. 1, with the fixed panel exploded from the door panel to show the pin on the door panel.

The first panel 202 also comprises a first guide member 232 such as guide member 108 illustrated in FIGS. 1A and 2A while the second panel 204 comprises a second guide member 234 such as guide member 110 also illustrated in FIGS. 1A and 2A. The guide members 232 and 234 form together a guiding assembly 240 which allows a predetermined relative motion between the panels 202 and 204.

Still in the illustrated embodiment, the first guide member 232 includes an elongated guiding groove, such as groove 114, having a first end located towards the door panel 204 and a second end located away from the second panel 204. The second guide member 234 includes a pin, such as pin 120, which extends upwardly from the first panel 202 and is sized and shaped to be received in the guiding groove of the first guide member 232.

The guiding groove of the first guide member 232 is adapted to guide the first panel 202 along a non-linear path of travel as it moves between the open and closed positions. More specifically, the guiding groove of the first guide member 232 includes a first straight portion, such as portion 122, which is disposed at an angle relative to the plane in which the second panel 204 extends, and a second straight portion, such as portion 124.

When the door assembly 200 is in the closed position, the pin of the second guide member 234 is located at the first end of the guiding groove of the first guide member 232 and the second panel 204 is adjacent the first panel 202, without overlapping the first panel 202. In this position, both the first and second panels 202 and 204 may be parallel to one another. When the door assembly 200 is moved to the open position to thereby allow access into the shower, the door panel 204 is slid towards the first panel 202. Since the roller assembly engages the rail member as described above, the second panel 204 may only move linearly within the plane in which it extends and cannot move transversely. As the second panel 204 moves towards the open position, the pin of the second guide member 234 moves along the guiding groove of the first guide member 232 towards the second end thereof, and the motion of the pin along the guiding grove forces the rotation of the first panel 202.

When the door assembly 200 is in the closed position, the first panel 202 extends within a first panel plane and the second panel 204 extends within a second panel plane which intersects the first panel plane at a first non-zero angle so that the two panel planes in which the first and second panels 202 and 204 extend are not parallel to one another.

Figure 6:
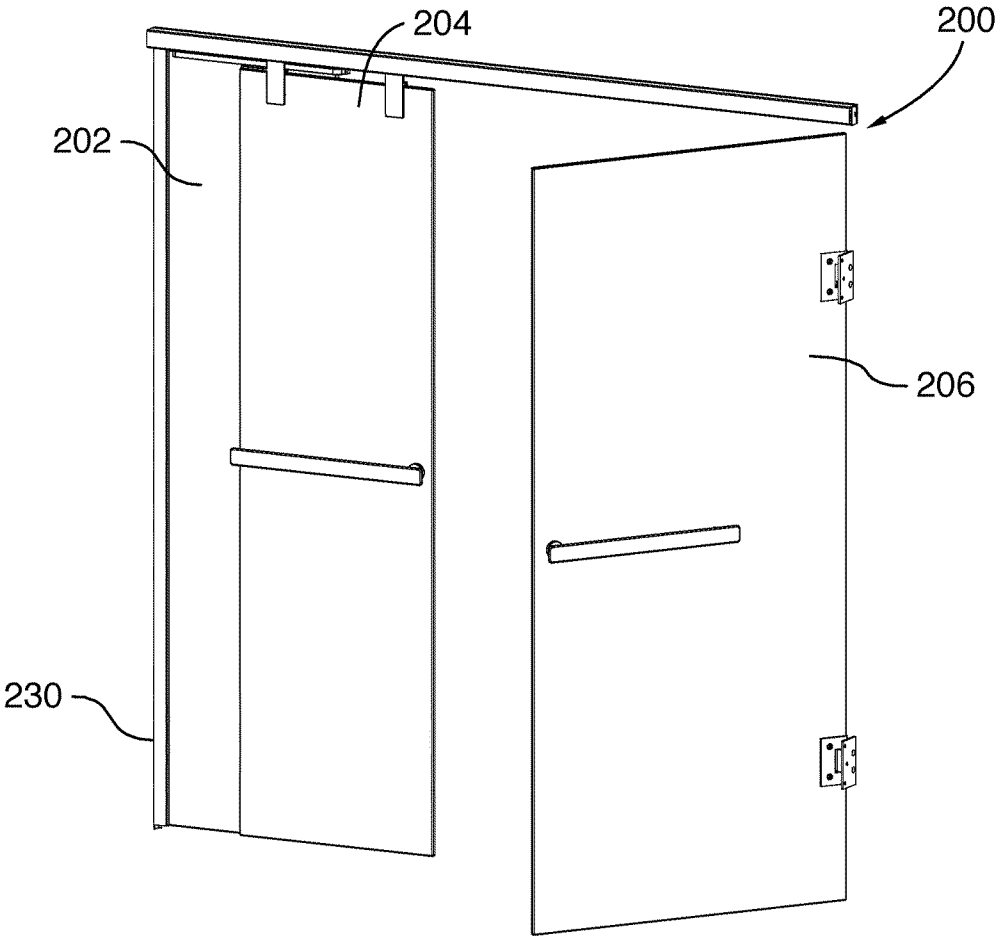
FIG. 6 is a drawing illustrating the door assembly of FIG. 4 when in intermediary between a closed position and an open position.
Figure 7:
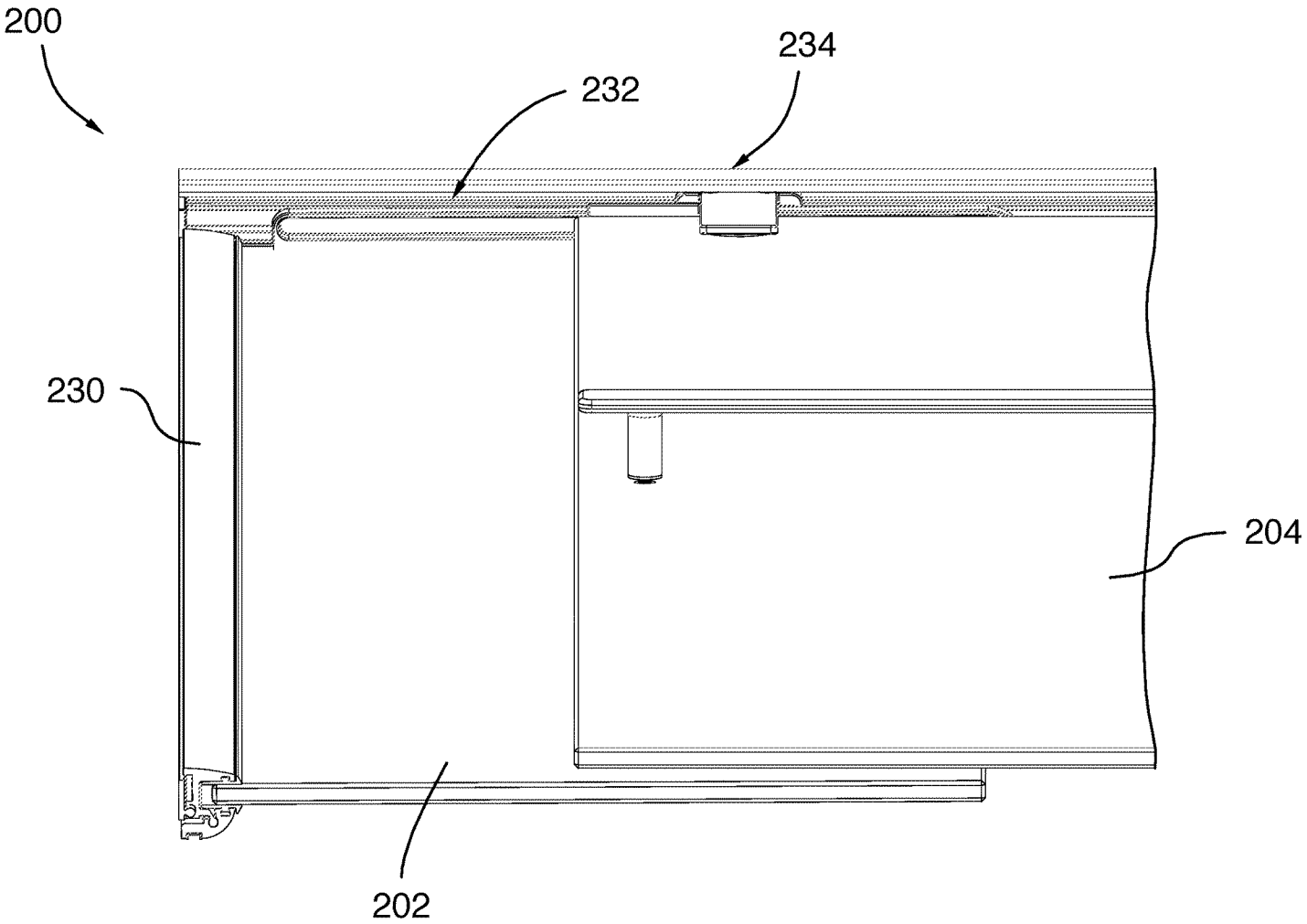
FIG. 7 is a drawing showing a bottom perspective view of the door assembly of FIG. 6.

FIGS. 6 and 7 illustrate the door assembly 200 in an intermediary position/configuration while the second panel 204 is moved from its closed position to its open position. By moving the second panel 204 towards the end 212 of the first panel 202, the second panel 204 slides within the second panel plane along the guiding structure 240. The motion of the second panel 240 triggers the rotation of the first panel 202 due to the interaction between the guide members 232 and 234 as described above. While the second panel 204 slides from the closed position towards the open position, the panel 202 rotates inwardly towards the interior space defined by the shower assembly so that the value of the angle between the first and second panels 202 and 204 decreases while still being greater than zero. In the intermediary position illustrated in FIG. 6, part of the second panel 204 overlaps with a portion of the first panel 202 and the second panel 204 is located partially in front of the first panel 202 while looking at the door assembly 200 from the exterior of the shower assembly.

Figure 8:
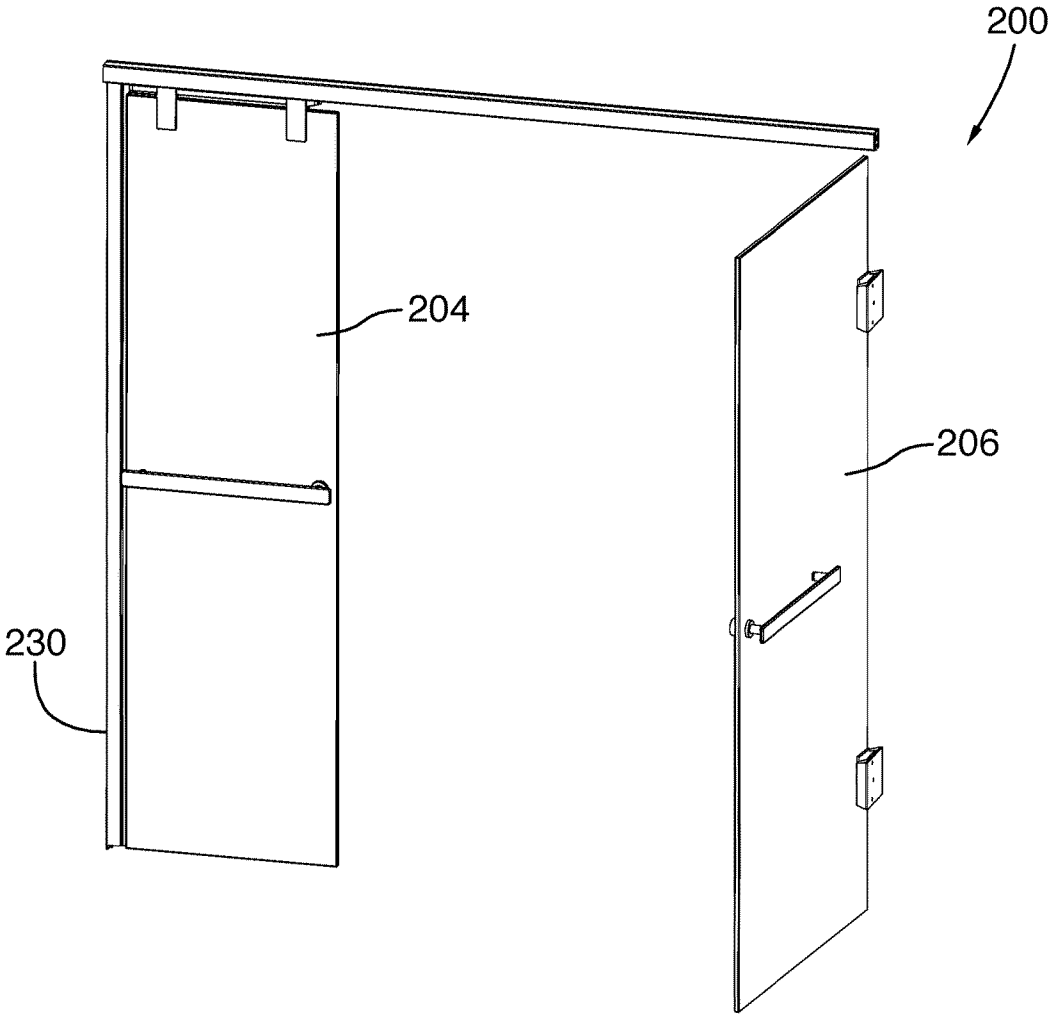
FIG. 8 is a drawing illustrating the door assembly of FIG. 4 when in an open position.
Figure 9:
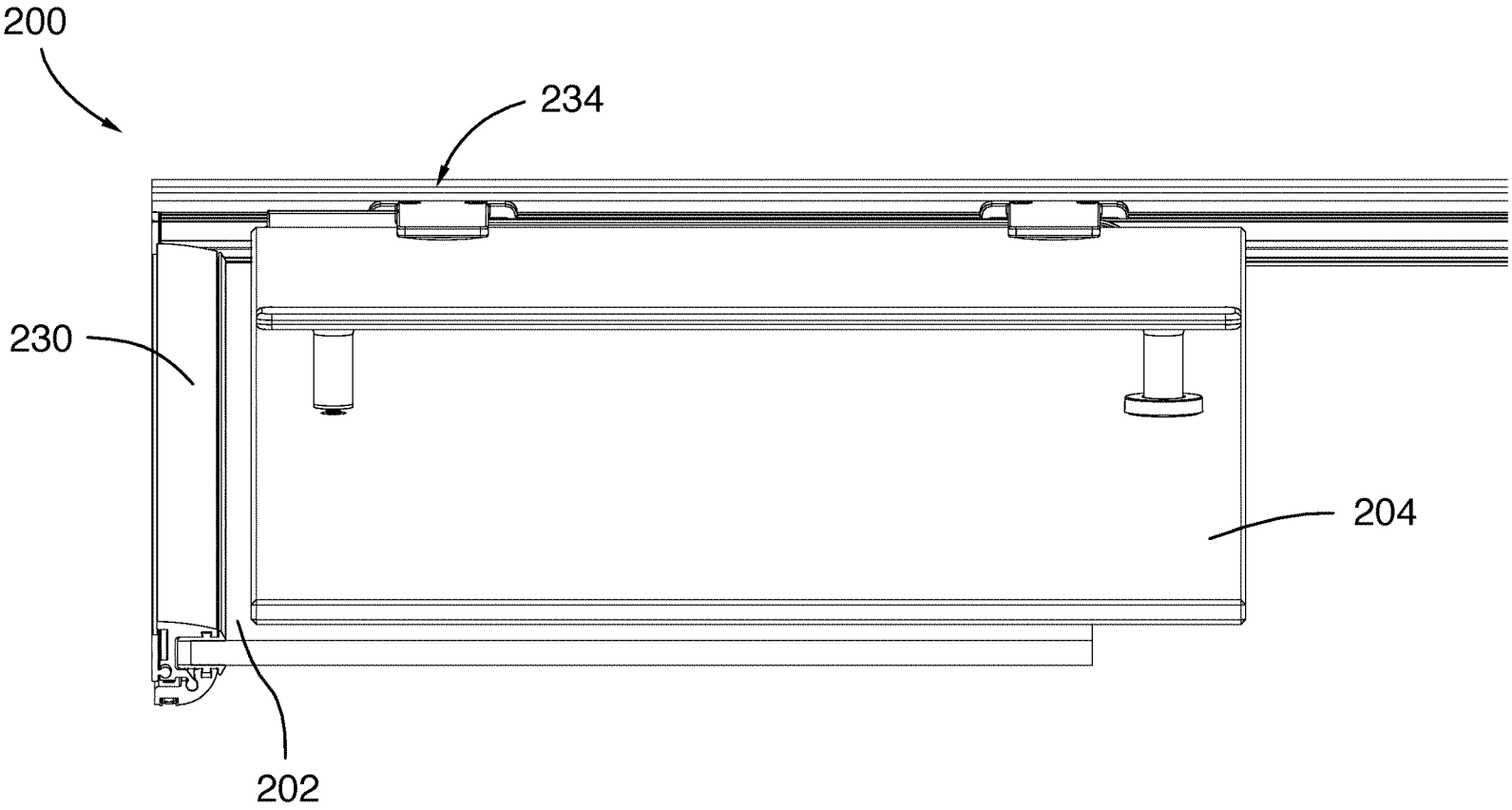
FIG. 9 is a drawing showing a bottom perspective view of the door assembly of FIG. 8.

By further moving the second panel 204, the door assembly 200 reaches the open position illustrated in FIGS. 8 and 9. The motion of the second panel 204 triggers a further rotation of the first panel 202 relative to the shower wall. A greater portion of the second panel 204 then overlaps with the first panel 202 and the first panel 202 is disposed within a third panel plane which is substantially parallel to the second panel plane so that the angle between the panels 202 and 204 be substantially equal to zero. In this position, the opening of the shower is maximal to allow a user entering or exiting the shower enclosure.

Figure 10:
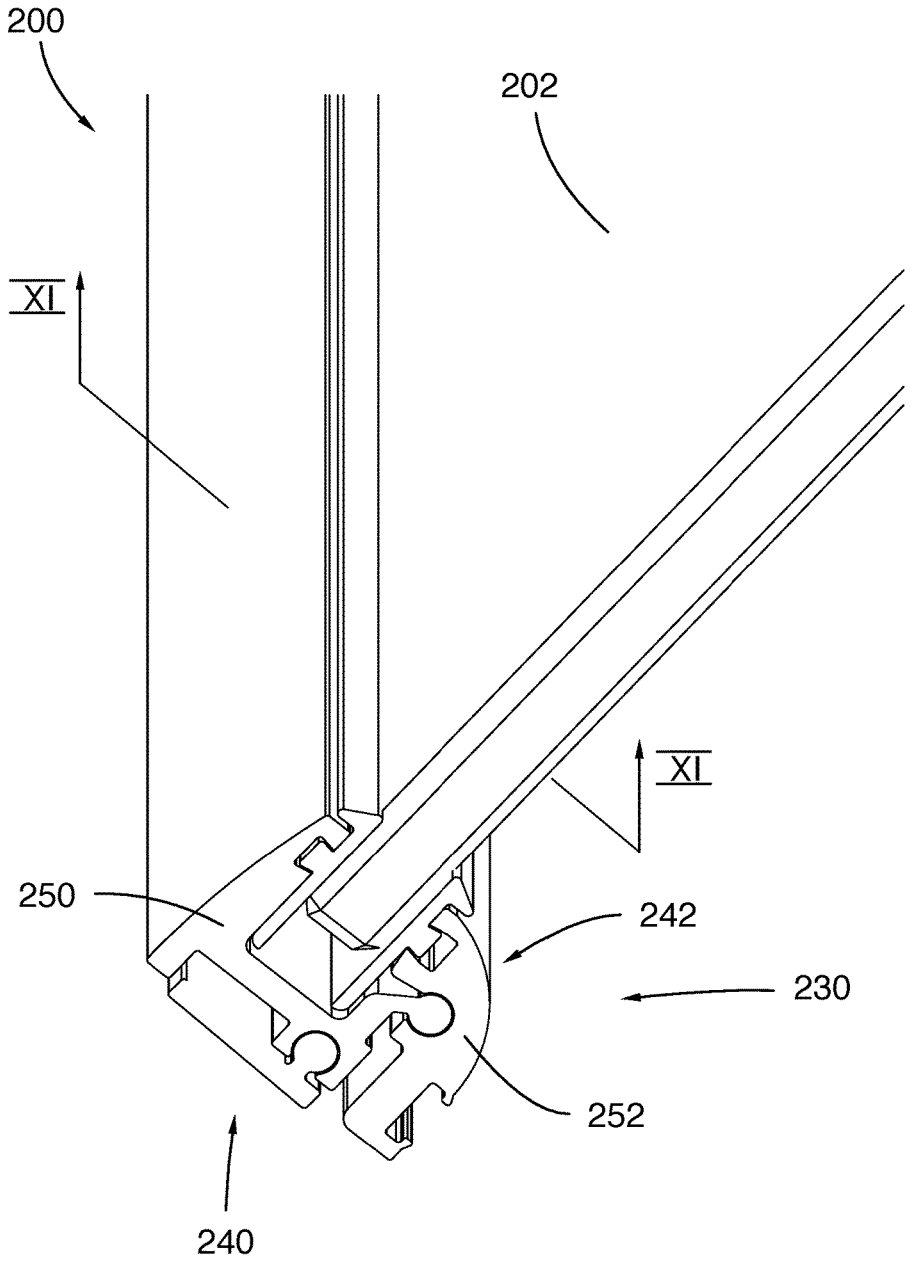
FIG. 10 is a drawing showing a bottom perspective view of a rotatable connection assembly for connecting a door panel to a support structure such as a wall, in accordance with an embodiment.
Figure 11:
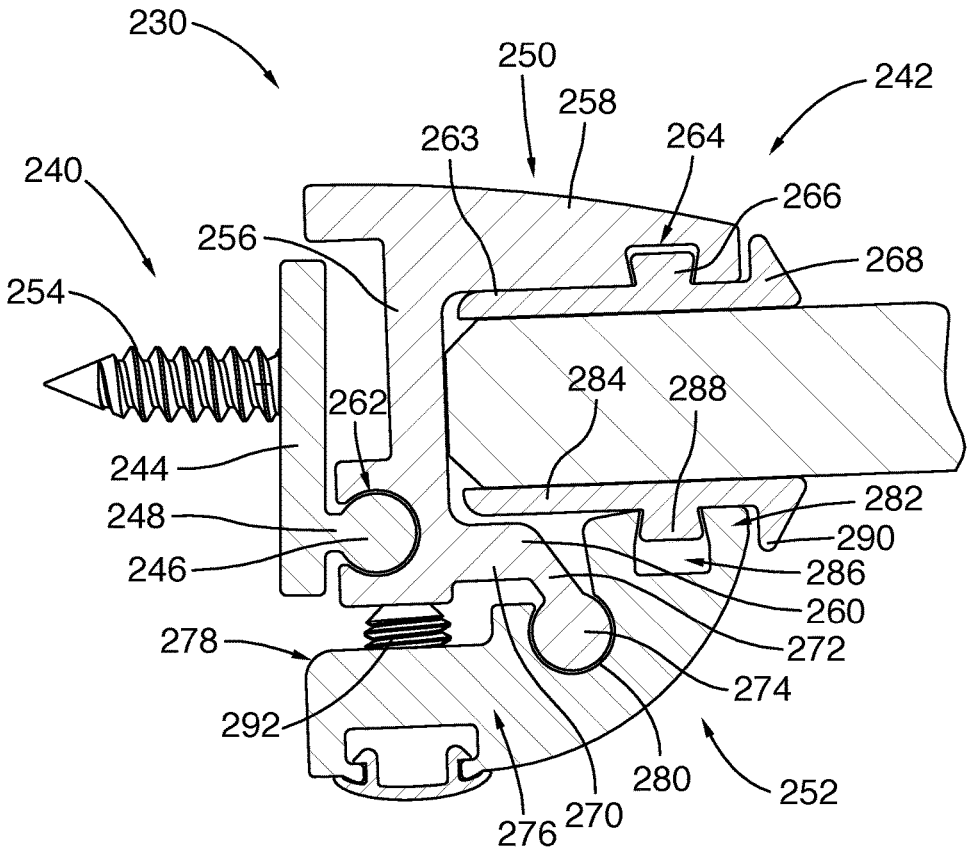
FIG. 11 is a drawing showing a cross-sectional view of the rotatable connection of FIG. 10, taken along cross-section line XI-XI.

FIGS. 10 and 11 illustrate an exemplary embodiment for the rotatable connection assembly 230 which allows rotatably securing the first panel 202 to the shower wall (not shown). While in the illustrated embodiment the connection assembly 230 extends along the entire vertical length of the first panel 202, it should be understood that other configurations may be possible. For example, the connection assembly 230 may only extend along a portion of the length of the first panel 202. In another embodiment, the door assembly 200 may comprise two or more connection assemblies 230 each located at a different location along the length of the first panel 202 and each extending along a portion of the length of the first panel 202.

The connection assembly 230 comprises a male or wall securing body 240 and a female or panel securing body 242. The female body 242 is adapted to be fixedly secured to the panel 202 and the male body 240 is adapted to be fixedly secured to the shower wall while the female body 242 is rotatably secured to the male body 240 to allow the rotation of the panel 202 relative to the shower wall about a vertical rotation axis.

The male body 240 comprises a plate 244, a cylindrical portion 246 and a neck portion 248 therebetween. The plate 244 extends along a given length such as the same length as that of the panel 202, a length that is shorter than that of the panel 202 or a length that is longer than that of the panel 202. The plate 244 is adapted to be fixedly secured to the shower wall or the bathroom wall. For example, the plate 244 may comprise at least one hole extending therethrough for receiving a screw 251 therethrough in order to secure the plate 244 to the shower wall as illustrated in FIG. 11. The cylindrical portion 246 extends along the length of the plate 244 and has a substantially circular cross-section. The cylindrical portion 246 is connected to the plate 244 via the neck portion 248 which has a width which is less that the diameter of the cylindrical portion 246.

The female body 242 comprises a male jaw portion 250 and a female jaw portion 252 rotatably secured together. The male and female jaw portions 250 and 252 are adapted to receive the panel 202 therebetween so that the panel 202 be fixedly secured between the male and female jaw portions 250 and 252. The male jaw portion 250 comprises a substantially U-shaped plate 264 formed of a cylinder receiving plate 256, a first arm 258 and a second arm 260. The cylinder receiving plate 256 has a width which is greater than that of the panel 202 and extends along at least a portion of the length of the panel 202.

The cylinder receiving plate 256 comprises a substantially cylindrical aperture or recess 262 which extends on a face thereof that faces the plate 244 of the male body 240. The diameter of the aperture 262 substantially corresponds to that of the cylindrical portion 246 so that the cylindrical portion 246 be inserted into the aperture 262 and the male jaw portion 250 be rotated about the cylindrical portion 246. While in the illustrated embodiment, the aperture is located adjacent to an end of the plate 256, it should be understood that the aperture 262 may be located at any other adequate location along the width of the plate 256.

The first arm 258 projects substantially orthogonally from the plate 256 at an end opposite thereof opposite to the aperture 262 and in a direction opposite to the male body 240. In one embodiment, the face of the arm 258 that faces the second arm 260 is adapted to be in direct physical contact with the panel 202. In another embodiment, the connection assembly 230 further comprises an anti-skid or non-slip body 263 to be positioned between the first arm 258 and the panel 202. The anti-skid body 263 is used for protecting the panel 202 when the first arm 258 is pushed against the panel 202 and for preventing any relative motion between the first arm 258 and the panel 202. For example, the anti-skid body 262 may be made of rubber. It should be understood that any adequate method for removably or permanently secure the anti-skid body 263 to the first arm 258 may be used. In the illustrated embodiment, the first arm 258 comprises a recess 264 on its face facing the panel 202 and the anti-skid body 263 comprises a protrusion 266 that matches the recess 264 for insertion therein. In the illustrated embodiment, the recess 264 and the protrusion 266 each have a matching isosceles trapezoidal shape. In one embodiment, the recess 264 is terminated by a wall at its bottom end to maintain the anti-skid body 263 into position.

In one embodiment, the anti-skid 263 is terminated by a substantially triangular section 268 to prevent water from propagating between the anti-skid body 263 and the first arm 258.

The second arm 260 extends from the plate 256 from a face that is opposite to the aperture 262 in the direction opposite to the male body 240. The second arm comprises a first section 270 which is substantially parallel to the first arm 258, a second section which extends away from the first arm 258 and a cylindrical section 274 which extends from the second section 272. The cylindrical section 274 allows the female jaw portion 252 rotating relative to the male jaw portion 250.

The female jaw portion 252 comprises a substantially curved plate 276 having an inward face that faces the male jaw portion 250. The inward face comprises a first planar section 278 that faces the plate 256 of the male jaw portion 250 and a cylindrical recess 280 for receiving the cylindrical section 274 of the male jaw portion 250. The plate 276 further comprises a hole extending through the first planar section 278 and designed to receive a bolt 292 therethrough.

In one embodiment, the end 282 of the plate 276 is adapted to be in direct physical contact with the panel 202. In another embodiment, the connection assembly 230 further comprises a second anti-skid or non-slip body 284 to be positioned between the end 282 of the plate 276 and the panel 202. The anti-skid body 284 is used for protecting the panel 202 when the plate 276 is pushed against the panel 202 and for preventing any relative motion between the plate 276 and the panel 202. For example, the anti-skid body 284 may be made of rubber. It should be understood that any adequate method for removably or permanently secure the anti-skid body 284 to the plate 276 may be used. In the illustrated embodiment, the end 282 of the plate 276 comprises a recess 286 and the anti-skid body 284 comprises a protrusion 288 designed to be inserted into the recess 286. In the illustrated embodiment, the recess 286 and the protrusion 288 each have an isosceles trapezoidal shape. In one embodiment, the recess 286 is terminated by a wall at its bottom end to maintain the anti-skid body 284 into position.

In one embodiment, the anti-skid 284 is terminated by a substantially triangular section 290 to prevent water from propagating between the anti-skid body 284 and the plate 276.

In order to rotatably secure the panel 202 to a wall (not shown), the male body 240 of the connection assembly 230 is screwed to the wall by screwing screws 251 through holes extending through the plate 244. Then the male jaw portion 250 is rotatably secured to the male body 240 by inserting the cylindrical portion 246 of the male body 240 into the recess 262 of the male jaw portion 250 and sliding the male jaw portion relative along the cylindrical portion 246 optionally until the cylindrical portion 246 abuts a wall located at the bottom end of the recess 262. Then the female jaw portion 252 is rotatably secured to the male jaw portion 250 by inserting the cylindrical section into the recess 280 and sliding the female jaw portion 252 along the recess 280 until it abuts against a wall terminating the recess 280 at the bottom end thereof.

Then the panel 202 is inserted between the male and female jaw portions 250 and 252. In an embodiment in which the connection assembly 230 comprises the first and second anti-skid bodies 263 and 284, the anti-skid body 263 is inserted between the male jaw portion 250 and the panel 202 and the anti-skid body 284 is inserted between the female jaw portion 252 and the panel 202.

The bolt 292 is then screwed in the hole extending through the first planar section 278. The bolt 292 is screwed until it abuts against the part of the male jaw portion 250 that faces the aperture 262. Further screwing the bolt 292 then triggers the rotation of the female jaw portion 252 relative to the first male jaw portion 250 and allows firmly abutting the end 282 of the plate 276 against the panel 202, thereby securing the panel 202 between the male and female jaw portions 205 and 252.

In one embodiment, the connection assembly 230 is provided with a plurality of bolts 292 positioned along the length of the female jaw portion 252.

It should be understood that the order of the above-described steps for rotatably securing the panel 202 to a wall may be changed. For example, the female jaw portion 252 may first be rotatably secured to the male jaw portion 250, then the male jaw portion may be rotatably secured to the male body 240 before securing the male body 240 to the wall.

Figure 12:
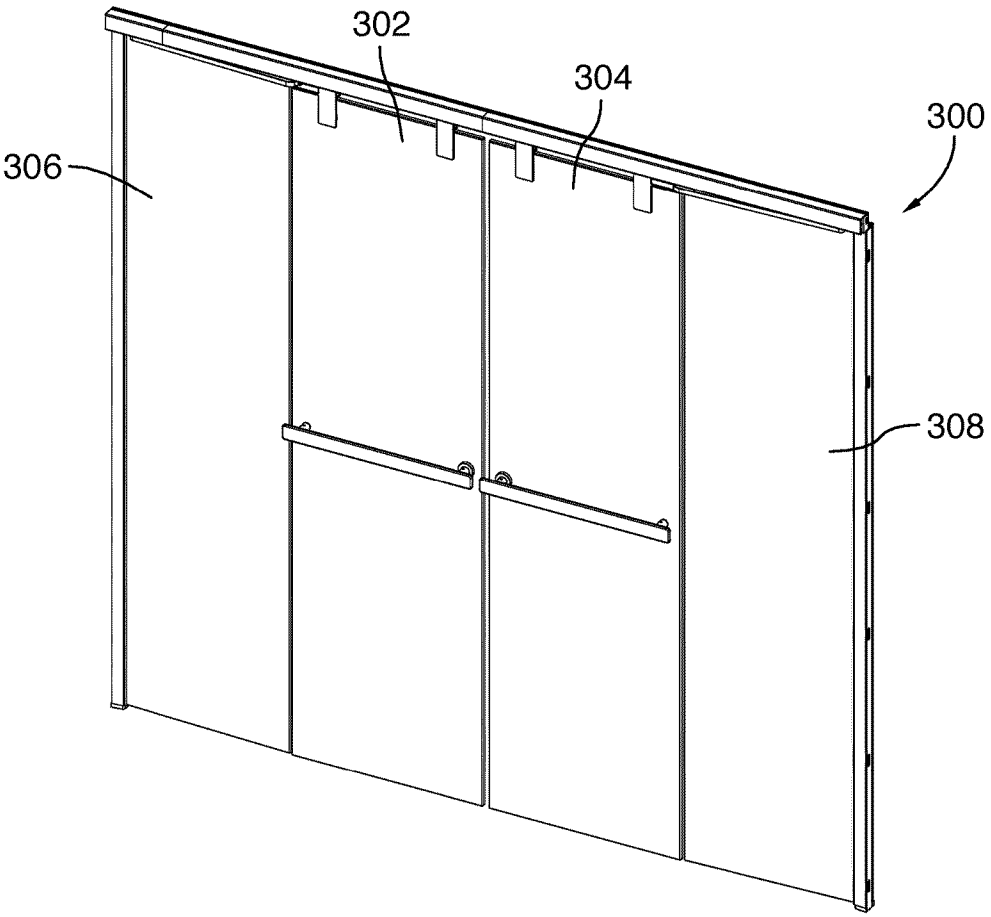
FIG. 12 is a drawing showing a door assembly comprising two slidable door panels and two rotatable door panels, in accordance with an embodiment and in a closed position.
Figure 13:
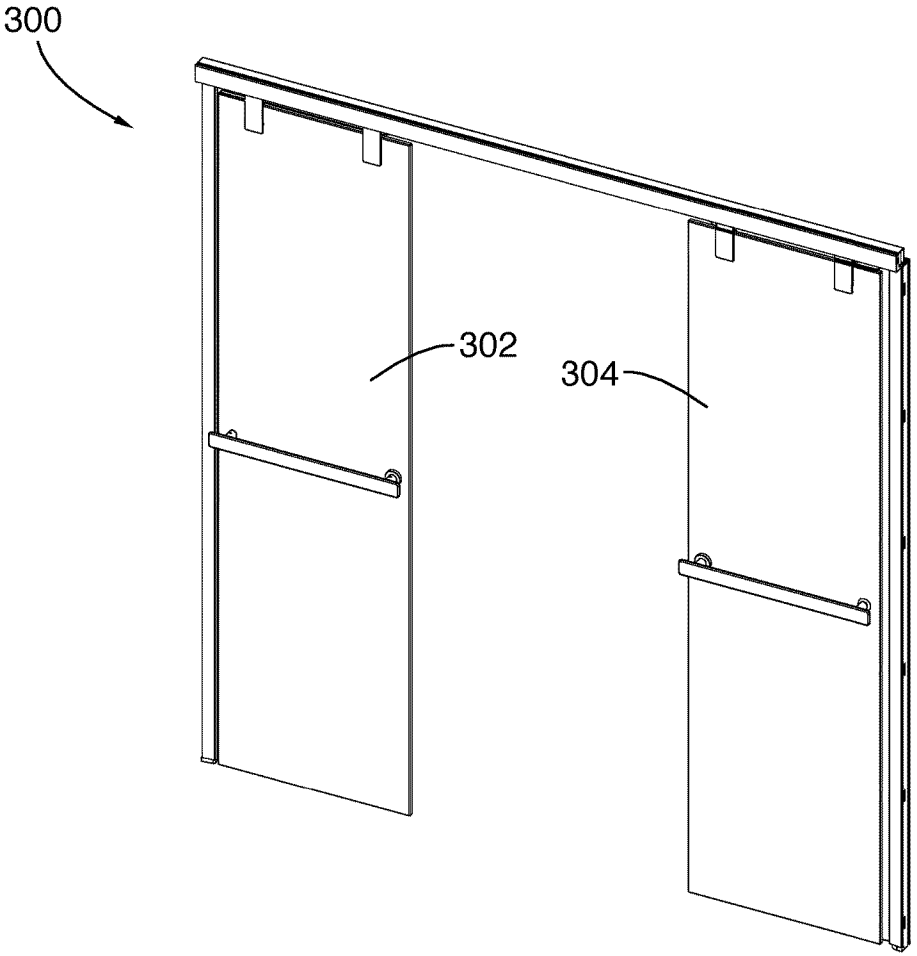
FIG. 13 is a drawing showing the door assembly of FIG. 12 in an open position.

While the door assembly 200 comprises a single slidable panel 204, it should be understood that a door assembly may comprise more than one slidable panel. For example, FIGS. 12 and 13 illustrates a door assembly 300 in a closed position and an open position, respectively. The door assembly 300 comprises two slidable panels 302 and 304 and two rotatable panels 306 and 308 which are rotatably secured to opposite walls of a shower assembly. Each panel 306 and 308 is provided with a guide member 232 and each panel 302 and 304 is provided with a guide member 234. As a result, sliding the panel 302 towards the panel 306 triggers the rotation of the panel 306 and sliding the panel 304 towards the panel 308 triggers the rotation of the panel 308.

It should be understood that the rotatable connection assembly 230 is exemplary only and that any adequate rotatable connection allowing securing the panel 202 to a wall may be used.

The invention claimed is:

1. A door assembly for a bathing enclosure, comprising:

a frame;

a rotatable panel rotatably securable to a wall; and a slidable panel slidably secured to the frame, wherein a sliding motion of the slidable panel triggers a rotation of the rotatable panel, wherein the door assembly is movable between an open position and a closed position, wherein when the door assembly is in the closed position, the rotatable and slidable panels are adjacent to one another and are unparallel and wherein when the door assembly is in the open position, the rotatable and slidable panels overlap one another and are parallel together.

2. The door assembly of claim 1, further comprising a first guide member secured to the rotatable panel and a second guide member secured to the slidable panel and engageable with the first guide member for triggering the rotation of the rotatable panel.

3. The door assembly of claim 2, wherein the first guide member comprises a groove extending therealong.

4. The door assembly of claim 3, wherein the groove comprises a first groove portion being parallel to the rotatable panel and a second groove portion extending from the first groove portion at an angle therefrom, the second groove portion being adjacent to the slidable panel when the door assembly is in the closed position.

5. The door assembly of claim 3, wherein the second guide member comprises a pin sized and shaped to be received in the groove, a motion of the pin within the groove triggering the rotation of the rotatable panel.

6. The door assembly of claim 1, further comprising a rail member extending along the frame and a roller assembly secured to the slidable panel and engaging the rail member to allow a sliding motion of the slidable panel relative to the frame.

7. The door assembly of claim 1, further comprising a rotating connector assembly securable to the wall and the rotatable panel.

8. The door assembly of claim 7, wherein the rotating connector assembly comprises a plate securable to the wall and a panel receiving member rotatably secured to the plate, the panel receiving member for receiving the rotatable panel therein.

9. The door assembly of claim 8, wherein the plate comprises a cylindrical protrusion protruding therefrom and the panel receiving member comprises a cylindrical recess for receiving the cylindrical protrusion therein and allowing a rotation of the panel receiving member relative to the plate.

10. The door assembly of claim 8, wherein the panel receiving member has a substantially U-shape for receiving the rotatable panel therein.

11. The door assembly of claim 10, wherein the panel receiving member composes a male jaw portion and a female jaw portion rotatably secured to the male jaw portion, the rotatable panel being receivable between the male and female jaw portions.

12. The door assembly of claim 11, further comprising a securing means for fixedly securing the male and female jaw portions together once the rotatable panel is received therebetween.

13. The door assembly of claim 12, wherein the securing means comprises a bolt, the female jaw portion comprises an opening for receiving the bolt therein, the bolt abutting against the male jaw portion when inserted into the opening for fixedly securing the rotatable panel between the male and female jaw portions.

14. The door assembly of claim 11, further comprising a first anti-skid body to be installed between the male jaw portion and the rotatable panel and a second anti-skid body to be installed between the female jaw portion and the rotatable panel.

15. The door assembly of claim 1, wherein the rotatable and slidable panels are made of glass.

16. The door assembly of claim 1, wherein the bathing enclosure is a shower enclosure.

17. The door assembly of claim 1, wherein the bathing enclosure is a bathtub enclosure.

18. The door assembly of claim 1, wherein the wall is a bathroom wall.

19. The door assembly of claim 1, wherein the wall is part of the frame.

20. A door assembly for one of a bathtub enclosure and a shower enclosure, comprising:

a frame;

a first door panel;

a rotatable connector securable to a wall and secured to the first door panel for allowing a rotation of the first door panel relative to the wall;

a second door panel;

a sliding member secured to the frame and operatively connected to the second door panel for allowing a sliding motion of the second door panel along the frame;

a first guide member secured to the first door panel; and a second guide member secured to the second door panel and operatively connected to the first guide member for triggering the rotation of the first door panel upon sliding of the second door panel.

* * * * *